US007952452B2

(12) United States Patent
Morga

(10) Patent No.: US 7,952,452 B2
(45) **Date of Patent: *May 31, 2011**

(54) FILTER WITH MULTIPLE IN-LINE SHUNT ZEROS

(75) Inventor: Justin Russell Morga, Edgewood, NM (US)

(73) Assignee: CTS Corporation, Elkhart, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/454,541

(22) Filed: May 19, 2009

(65) Prior Publication Data

US 2009/0231062 A1 Sep. 17, 2009

Related U.S. Application Data

(63) Continuation of application No. 11/434,484, filed on May 15, 2006, now Pat. No. 7,545,240.

(51) Int. Cl.
*H01P 1/205* (2006.01)

(52) U.S. Cl. ..... 333/202; 333/206

(58) Field of Classification Search ..... 333/202, 333/206, 134

See application file for complete search history.

(56) References Cited

U.S. PATENT DOCUMENTS

| | | | |
|---|---|---|---|
| 4,692,726 | A | 9/1987 | Green et al. |
| 4,823,098 | A | 4/1989 | DeMuro et al. |
| 4,896,124 | A | 1/1990 | Schwent |
| 4,954,796 | A | 9/1990 | Green et al. |
| 5,250,916 | A | 10/1993 | Zakman |
| 5,404,120 | A | 4/1995 | Agahi-Kesheh |
| 5,502,422 | A | 3/1996 | Newell et al. |
| 5,684,439 | A | 11/1997 | Vangala |
| 5,731,746 | A | 3/1998 | Sokola et al. |
| 5,864,264 | A | 1/1999 | Hino |
| 5,864,265 | A | 1/1999 | Balance et al. |
| 5,889,447 | A | 3/1999 | Newell et al. |
| 5,929,721 | A | 7/1999 | Munn et al. |
| 6,462,629 | B1 | 10/2002 | Blair et al. |
| 6,559,735 | B1 | 5/2003 | Hoang et al. |
| 6,650,202 | B2 | 11/2003 | Rogozine et al. |
| 6,696,905 | B2 | 2/2004 | Umeda et al. |

(Continued)

FOREIGN PATENT DOCUMENTS

WO WO97/035352 9/1997

(Continued)

OTHER PUBLICATIONS

Y. Campa, CER0143A Specifications, Oct. 19, 2004, pp. 1-11, CTS Corporation, Albuquerque, New Mexico.

*Primary Examiner* — Benny Lee
(74) *Attorney, Agent, or Firm* — Daniel J. Deneufbourg

(57) ABSTRACT

A filter including at least two resonator through-holes defining apertures in the top surface surrounded by respective plates which in combination with associated through-holes define primary and secondary shunt zeros providing low ripple and high rejection adjacent the bandpass. In one embodiment, the through-hole of the primary shunt zero is coupled directly to an input/output pad, while the through-hole of the secondary shunt zero is indirectly coupled to the input/output pad via a coupling bar extending between the input/output pad and the secondary shunt zero. In another embodiment, the secondary shunt zero may be coupled directly to the input/output pad. In a further embodiment, additional resonator through-holes in combination with associated plates define additional shunt zeros coupled directly or indirectly to the input/output pad.

4 Claims, 4 Drawing Sheets

U.S. PATENT DOCUMENTS

| | | | | |
|---|---|---|---|---|
| 6,828,883 | B1 | 12/2004 | Kitajima et al. | |
| 6,867,663 | B2 | 3/2005 | Umeda et al. | |
| 6,879,222 | B2 | 4/2005 | Vangala et al. | |
| 7,075,388 | B2 | 7/2006 | Rogozine et al. | |
| 7,545,240 | B2 * | 6/2009 | Morga | 333/202 |

FOREIGN PATENT DOCUMENTS

| | | |
|---|---|---|
| WO | WO03/073551 | 2/2003 |
| WO | WO2004/093239 | 10/2004 |

* cited by examiner

FILTER WITH MULTIPLE IN-LINE SHUNT ZEROS

CROSS-REFERENCE TO RELATED APPLICATION

This application is a continuation application which claims the benefit of U.S. patent application Ser. No. 11/434,484 filed on May 15, 2006, entitled Filter with Multiple Shunt Zeros, now U.S. Pat. No. 7,545,240, issued Jun. 9, 2009, the disclosure of which is explicitly incorporated herein by reference, as are all references cited therein.

TECHNICAL FIELD

This invention relates to electrical filters and, in particular, to a dielectric filter with multiple shunt zeros.

BACKGROUND OF THE INVENTION

As is well known in the art, filters provide for the attenuation/rejection of signals with frequencies outside of a particular frequency range and little rejection/attenuation to signals with frequencies within a particular range of interest. These filters most typically take the form of blocks of ceramic material having one of more resonators/poles formed therein such as, for example, the ceramic filters disclosed in U.S. Pat. No. 4,431,977 to Sokola et al. and U.S. Pat. No. 4,692,726 to Green et al. A ceramic filter may be constructed to define a lowpass filter, a bandpass filter or a highpass filter.

In a bandpass filter, the bandpass area is centered at a particular frequency and has a relatively narrow bandpass region, where little attenuation/rejection is applied to the signal.

The bandwidth of a filter can be designed for specific bandpass requirements. Typically, the tighter or narrower the bandpass, the higher the insertion loss, i.e., an important electrical parameter. A wider bandwidth, however, reduces a filter's ability to attenuate/reject unwanted frequencies, i.e., frequencies which are known in the art as rejection frequencies.

The use and application of a shunt zero such as, for example, the shunt zeros of the filters disclosed in FIG. 1 herein and, additionally, U.S. Pat. No. 5,502,422 to Newell et al. and U.S. Pat. No. 5,864,265 to Ballance et al. has been shown to improve the performance of filters by creating a notch or sharp point of increased rejection/attenuation as shown in FIG. 4 at a point close to the low side of the bandpass.

One disadvantage, however, which has been associated with the use of a single shunt zero is the increase in insertion loss and bandpass frequency ripple (e.g., the delta between the minimum and maximum points of a bandpass's insertion loss) as the rejection/attenuation moves closer and closer to the start and/or stop frequencies of the bandpass.

This disadvantage is of particular significance and consequence in repeater, micro cell and pico cell filter applications where high rejection and low bandpass ripple are two of the critical performance parameters.

Specifically, it is known in the art that repeaters, one of the intended applications of the filter of the present invention, are designed to eliminate reception problems in homes, office buildings, hotels, restaurants, etc. by amplifying the RF signal which is received before forwarding the RF signal either to a handset or base station. Most repeaters cascade filters in series with an amplifier therebetween to achieve the desired frequency rejection/attenuation. However, when filters are set up in series, high ripple and low rejection become a problem since lesser rejection causes distortion and excess ripple reduces the effective transmission distance of the repeater.

There thus remains a need for a filter designed to provide a high rejection/attenuation without a concomitant increase in ripple for repeater, micro cell and pico cell applications. The filter of the present invention meets these needs.

SUMMARY OF THE INVENTION

The present invention relates to a filter comprising a block defined by top, bottom and side surfaces where the side and bottom surfaces are substantially covered with a conductive material. A plurality of spaced-apart through-holes, which are also covered by a conductive material, extend between the top and bottom surfaces of the block and define a plurality of spaced-apart apertures in the top surface.

A plurality of plates comprised of conductive material surround a plurality of the respective apertures for capacitively or inductively coupling the respective through-holes to each other and to the conductive material on the side surfaces of the block.

In accordance with the present invention, at least first and second shunt zeros are defined by at least two of the plates in combination with the two of the resonator through-holes respectively associated therewith.

The filter additionally comprises at least one input/output pad which is capacitively or inductively coupled directly or indirectly to the respective through-holes of the first and second shunt zeros.

In one embodiment, the input/output pad is capacitively or inductively coupled directly to the one of the through-holes of the first shunt zero and a separate capacitive coupling bar extends between the input/output pad and the plate of the second shunt zero for indirectly capacitively or inductively coupling the second shunt zero to the input/output pad.

The combination of a filter with multiple shunt zeros directly or indirectly capacitively or inductively coupled to an input/output pad advantageously provides a high rejection/attenuation without any corresponding increase in ripple.

BRIEF DESCRIPTION OF THE DRAWING FIGURES

In the accompanying drawings that form part of the specification, and in which like numerals are employed to designate like parts throughout the same, FIG. 1 is an enlarged, simplified perspective view of a filter in accordance with the present invention;

DETAILED DESCRIPTION OF THE PREFERRED EMBODIMENT

While this invention is susceptible to embodiments in many different forms, this specification and the accompanying drawings disclose only one preferred embodiment as an example of the present invention. The invention is not intended, however, to be limited to the embodiment so described.

Figure 2:
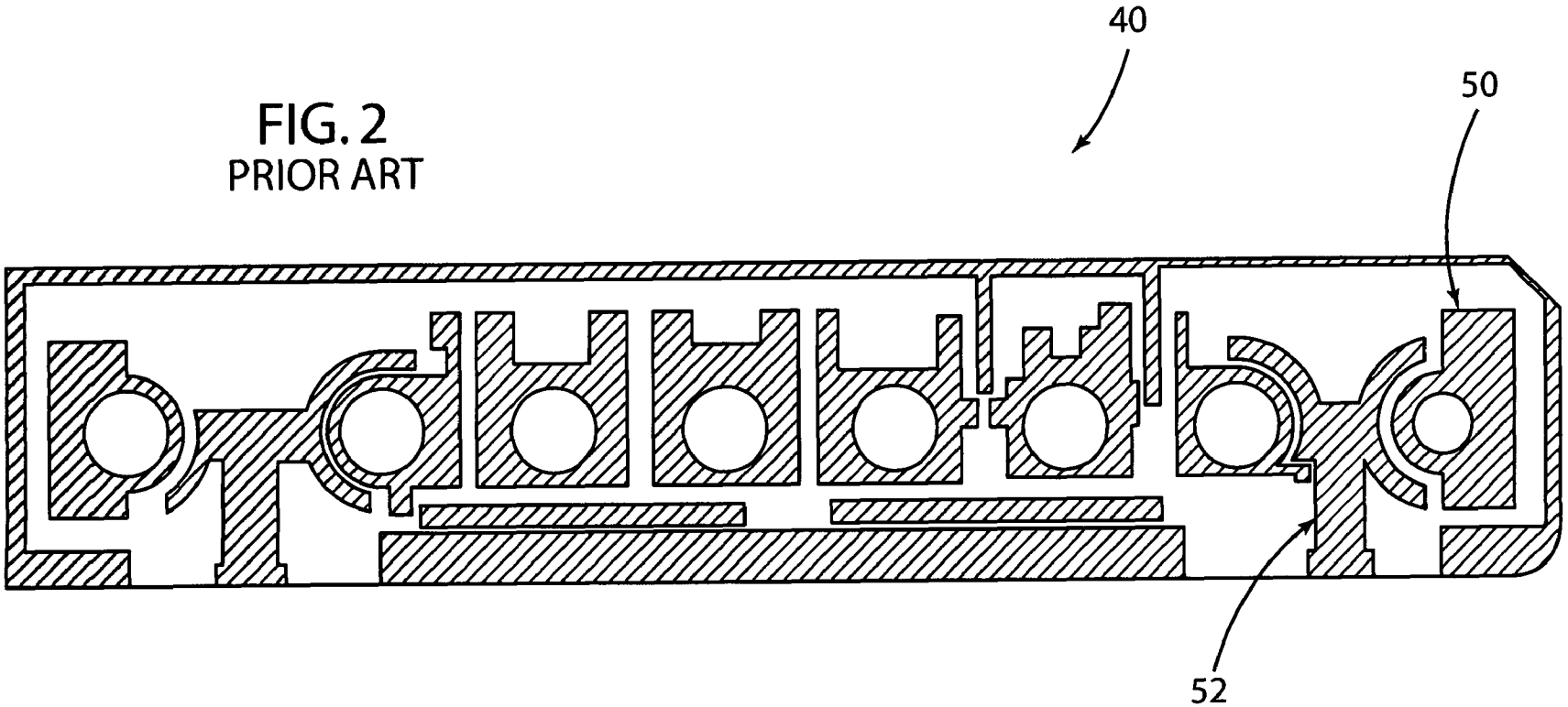
FIG. 2 PRIOR ART
FIG. 2 is an enlarged top plan view of the details of the pattern of metallized and unmetallized areas on the top surface of a standard ceramic filter incorporating a single shunt zero.

FIG. 2 depicts the top surface of a standard ceramic monoblock filter 40 incorporating a single shunt zero 50 of the same general type disclosed in, for example, U.S. Pat. No. 6,559,735 to Hoang and Vangala; and U.S. Pat. No. 5,502,422 to Newell et al. Shunt zero 50 is coupled directly to an input/output pad 52.

Figure 1:
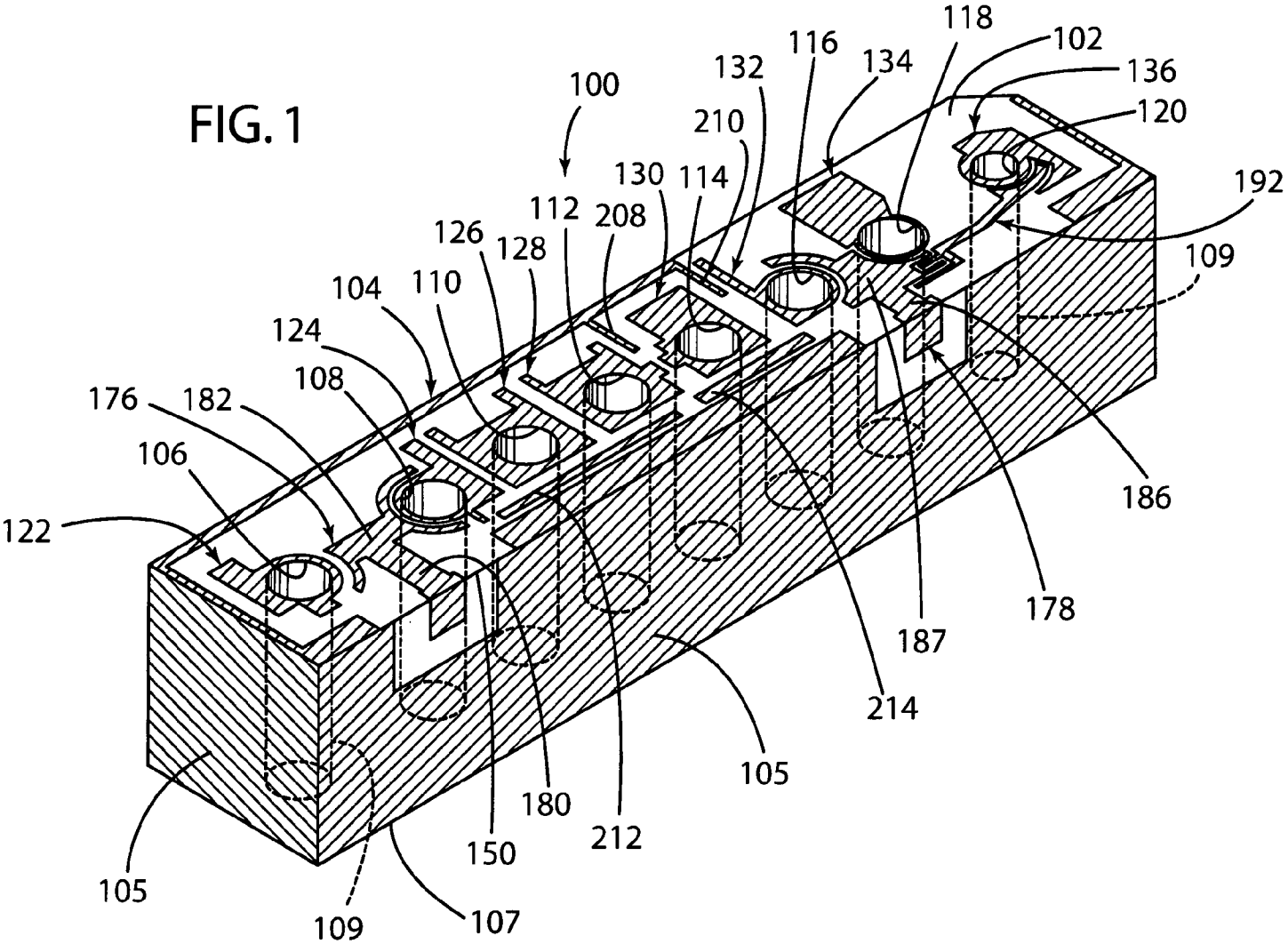
Figure 3:
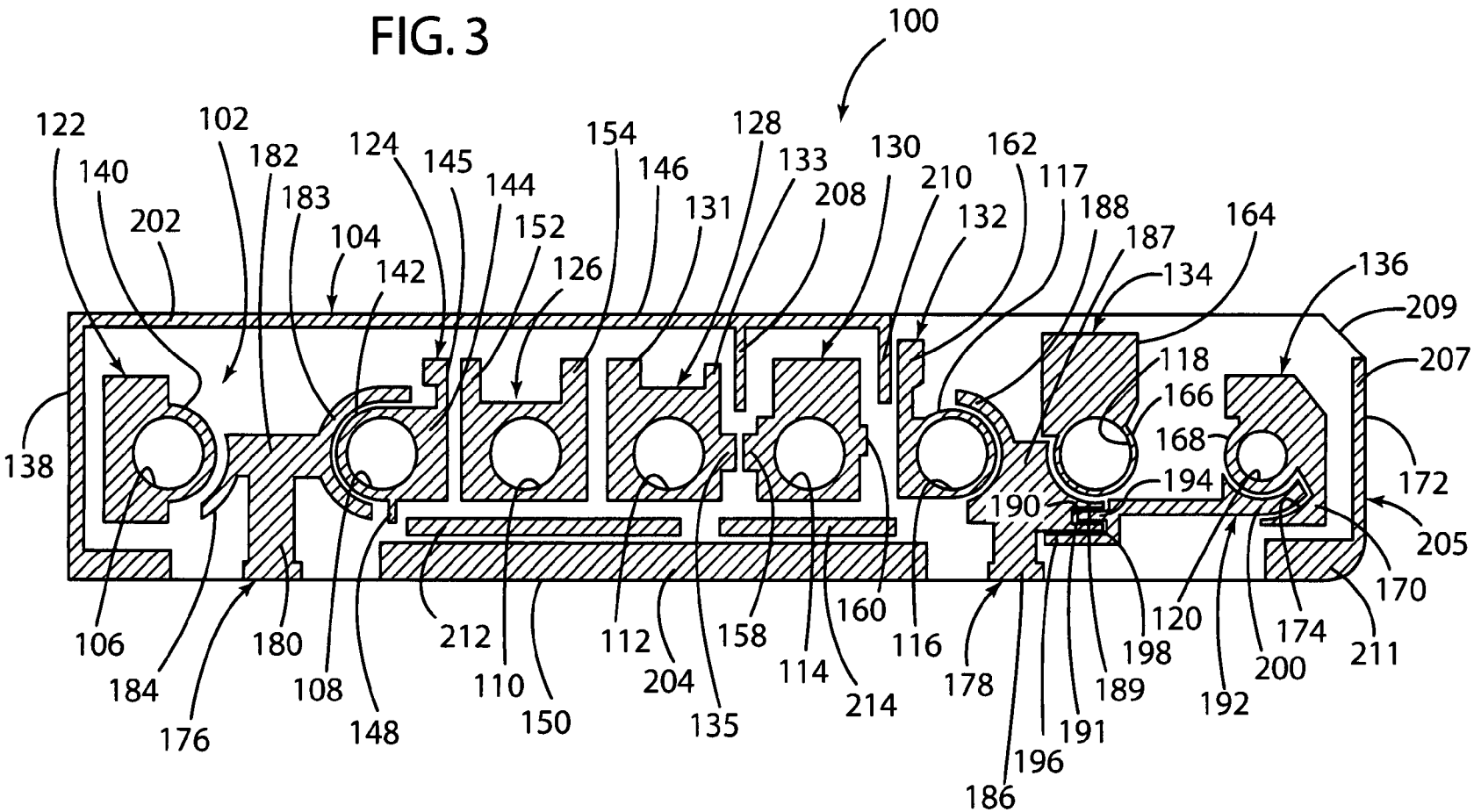
FIG. 3 is a top plan view of the top surface of the filter in accordance with the present invention which incorporates primary and secondary shunt zeros and an indirect coupling bar.

FIGS. 1 and 3 depict a simplex filter 100 constructed in accordance with the principles of the present invention. As is known in the art, a simplex filter is a filter with a single bandpass where one of the I/O (input/output) pads on the block provides the signal input and the other I/O pad provides the signal output. A bandpass filter's function is determined by the application. It is understood, however, that the invention is intended to encompass and apply equally to other types of monoblock filters including, but not limited to, duplexer and triplexer filters.

Filter 100 shown in FIGS. 1 and 3 is of the type and construction shown in, for example, U.S. Pat. No. 6,559,735 to Hoang and Vangala, the disclosure of which is hereby incorporated herein by reference. Specifically, it is understood that the block 104 of the filter 100 of the present invention is made of a suitable dielectric ceramic material and includes side and bottom faces 105 and 107 (FIG. 1 only) respectively which have been substantially fully plated with a conductive material. The conductive plating material is preferably made of copper, silver or an alloy thereof. Such plating preferably covers all surfaces of the block 104 with the exception of the top surface 102 where the conductive material covers only selected portions of the surfaces as described in more detail below.

The block 104 includes a plurality of through-holes 109 (FIG. 1) of the same type as disclosed in, for example, U.S. Pat. No. 6,559,735 to Hoang and Vangala. The through-holes extend between the top surface 102 and the bottom surface 107 and define interior surfaces coated with the same electrically conductive material which covers the outside of the block 104. Each of the holes defines a transmission line resonator or pole comprised of a short-circuited coaxial transmission line having a length selected for desired filter response characteristics. Reference may be made to U.S. Pat. No. 4,431,977 to Vangala for an additional description of the structure and function of the through-holes, the description of which is expressly incorporated herein by reference.

As shown in FIGS. 1 and 3, the through-holes 109 define respective circular openings or apertures 106, 108, 110, 112, 114, 116, 118, and 120. Although the block 104 of FIGS. 1 and 3 is shown with eight spaced-apart and co-linear openings extending along the length of the block 104 and defining eight through-holes/poles, it is understood that the invention encompasses any monoblock filter embodiment including two or more through-holes/poles depending, of course, upon the desired filter application.

The conductive plating material on the top surface 102 of the block 104 defines a plurality of distinct and spaced-apart conductive filter elements or plates of conductive material 122, 124, 126, 128, 130, 132, 134 and 136 which surround the apertures 106, 108, 110, 112, 114, 116, 118 and 120 respectively as described in more detail below. The plates 122, 124, 126, 128, 130, 132, 134 and 136 may be screen printed onto the top surface 102 as is known in the art or formed by laser patterning as disclosed in U.S. Pat. No. 6,462,629 to Blair et al.

Referring particularly to FIG. 3, plate 122 is generally rectangularly-shaped, is located between the left side top peripheral edge 138 of block 104 and the first aperture 106, and includes a strip of conductive material 140 which wraps around the full periphery of aperture 106. Plate 122 extends in an orientation generally parallel to block edge 138 and, in combination with the through-hole 109 associated therewith defining aperture 106, defines the high frequency side shunt zero of filter 100.

Plate 124 is generally in the shape of a "d" and includes a strip 142 which wraps around the full periphery of aperture 108 and a block 144 on the right side of aperture 108 defining a first top finger 145 extending in the direction of the top longitudinal edge 146 of the block 104 in an orientation generally normal to the edge 146. The tip of finger 145 defines a projection extending generally normally to the finger 145 and in the direction of block edge 138. A lower second finger 148 extends in the direction of the lower longitudinal peripheral edge 150 of block 104 in an orientation generally normal to the edge 150.

Plate 126 is in the shape of a square surrounding aperture 110 and defines a pair of fingers 152 and 154 extending upwardly from opposed corners of the top edge thereof in the direction of the top peripheral edge 146 of the block 104 and in an orientation generally normal to the edge 146. Finger 154 is slightly wider than finger 152.

Plate 128 is also generally rectangularly-shaped and surrounds aperture 112. Fingers 131 and 133 protrude and extend upwardly from opposed corners of the top edge thereof in the direction of the top peripheral edge 146 of block 104 and in an orientation generally normal to the edge 146. Finger 131 is wider and longer than the finger 133. Plate 128 additionally defines a third finger 135 which protrudes generally normally outwardly from the generally central portion of the right side edge of the plate 128.

Plate 130 is generally rectangularly-shaped and surrounds aperture 114. Fingers 158 and 160 protrude generally normally outwardly from opposed side edges respectively of plate 130. Finger 158 is aligned generally co-linearly with the finger 135 of plate 128 with the tips thereof being spaced apart from each other.

Plate 132 is generally in the shape of a "b" and includes a strip of conductive material 117 which wraps around the aperture 116 and an elongate base 162 extending generally upwardly from the left side of the aperture 116 in the direction of the upper longitudinal edge 146 of the block 104. Base 162 extends in a direction generally normal to, and terminates at a point just short of, the edge 146.

Plate 134 is in the form of a generally rectangularly-shaped block 164 of conductive material extending between the aperture 118 and the top peripheral edge 146 of the block 104. A strip of conductive material 166 wraps around the periphery of aperture 118. Moreover, and as described in more detail below, plate 134, in combination with the through-hole 109 associated therewith defining aperture 118, defines the primary (low frequency side) shunt zero of the filter of the present invention.

Plate 136 is generally in the shape of a "g" and defines the secondary (high frequency) shunt zero of the filter of the present invention as described in more detail below. Plate 136 defines a strip of conductive material 168 which wraps around the periphery of aperture 120 and a lower leg 170 extending generally downwardly between the aperture 120 and the right side peripheral edge 172 of the block 104. The leg 170 terminates in a hook which defines a slot 174 which faces the aperture 118.

The conductive plating material on the top surface 102 of block 104 additionally defines first and second I/O (input/output) frequency signal pads 176 and 178 respectively.

Pad 176 provides the signal input and is located between, and spaced from, plates 122 and 124 and includes both a vertically oriented base/trunk 180 and a horizontally oriented top 182 seated over the base 180 so as to define a "T". The right tip of the top 182 defines a semi-circularly-shaped extension 183 which wraps around and follows the contour of a portion of the aperture 108 in spaced relationship with the strip of conductive material 142 surrounding aperture 108. The left side tip of the top 182 defines a curved projection 184 depending downwardly therefrom and extending around (and following the contour of) a portion of the aperture 106 in spaced relationship with the strip 140 surrounding aperture 106.

As shown in FIGS. 1 and 3, the trunk 180 extends from the top 182 thereof on the top surface 102 in the direction of and then around the lower peripheral edge 150 of the block 104 and then down along the side surface 105 (FIG. 1 only) of the block 104 in a manner similar to the I/O pads of the filter disclosed in, for example, U.S. Pat. No. 5,502,422 to Heine et al., the disclosure of which is incorporated herein by reference.

Still referring to FIGS. 1 and 3, I/O pad 178 is located between, and spaced from, plates 132 and 134 and includes a generally vertically oriented base/trunk 186 similar in structure, function and location to the base/trunk 180 of I/O pad 176 and thus, as with the I/O pad 176, extends in the direction of and then wraps around the lower peripheral block edge 150 and then downwardly along the block side edge 105, in a relationship generally normal to the edge 150. As shown in FIG. 3 only, I/O pad 178 additionally defines a head 187 at the top of base 186 including a projection in the form of an ear 188 which surrounds a portion of the aperture 116 and, more specifically, in spaced relationship with the strip 117 of plate 132 surrounding aperture 116. Head 187 additionally defines first and second lower fingers 189 and 191 extending in the direction of right side block edge 172 and defining a slot/groove 190 located between the aperture 118 and the lower peripheral edge 150 of block 104.

The top surface 102 of block 104 additionally includes a strip of conductive material defining an elongate strip coupling bar 192 which indirectly electrically capacitively or inductively connects the plate 136 to the I/O pad 178. Coupling bar 192 is located between the apertures 118 and 120 on one side and the lower block edge 150 on the other side and extends generally horizontally between the plates 134 and 136 in a relationship generally parallel to both the upper and lower longitudinal edges 146 and 150 of block 104.

Bar 192 is generally in the shape of a fork which, at one end, terminates in a pair of spaced-apart, generally parallel, prongs or fingers 194 and 196 defining a slot 198. Finger 194 is located above finger 196. Bar 192 cooperates and is interfitted with I/O pad 178 in a tongue and groove type relationship wherein prong 194 is located within and extends into the groove/slot 190 defined in I/O pad 178 and the finger 191 of I/O pad 178 is located within and extends into the slot 198 defined in coupling bar 192. The respective prongs of bar 192 are spaced apart from and do not contact the respective fingers of I/O pad 178.

As shown in FIG. 3 only, the opposite end of the bar 192 defines a terminal handle 200 which is located in and extends into the slot 174 defined by the plate 136. Handle 200 is spaced apart from and does not contact the plate 136.

The top surface 102 of block 104 also includes additional ground strips of conductive material 202, 204 and 205 as shown in FIG. 3 only. Strip 202 extends along the combination of the periphery of the upper longitudinal block edge 146 between the side block edge 138 and finger 210, the full periphery of side block edge 138 between upper and lower edges 146 and 150, and a small portion of lower longitudinal block edge 150 and, more specifically, the portion of edge 150 located below the plate 122. The portion of strip 202 extending along the lower edge 150 is wider than the remaining portions thereof which are all of the same thickness. Strip 202 and, more particularly, the portion thereof extending along the periphery of upper block edge 146, additionally defines a pair of elongate and spaced-apart parallel fingers 208 and 210 protruding generally normally inwardly from the strip 202 and extending in the direction of plates 128 and 130 into a position wherein finger 208 extends into the gap defined between plates 128 and 130 and the finger 210 extends into the gap defines between plates 130 and 132.

Although not described herein in any detail, it is understood that the fingers 208 and 210 define high frequency side strip electrode means/transmission zeros of the type disclosed in U.S. Pat. No. 4,692,726 to Green et al., the disclosure of which is incorporated herein by reference. In the embodiment shown, finger 210 defines a strip of conductive material which is shorter than the strip of conductive material defining the finger 208.

Strip 204 is located along the periphery of lower longitudinal block edge 150 and extends generally between plates 124 and 132. Strip 205 extends along the periphery of side block edge 172 and the portion of lower longitudinal block edge 150 located below plate 136.

The top surface 102 of block 104 defines yet additionally elongate strips of conductive material 212 and 214 extending in a spaced-apart horizontal and co-linear relationship in the pace defined between the ground strip 204 and plates 124, 126, 128, 130. Strip 212 extends generally between the finger 148 of plate 124 and the plate 128 while the strip 214, which is shorter than the strip 212, extends generally between the right side edge of plate 128 and the left side edge of plate 130. Although not described herein in any detail, it is understood that the strips 212 and 214, which extend in a longitudinal direction between the ends of strip 204, define alternative signal coupling paths similar in structure and function to the alternative signal paths or strips of the filter disclosed in U.S. Pat. No. 6,559,735 to Hoang and Vangala. In the embodiment shown, strip 204 is wider than strips 212 and 214 which both have the same width.

Strip 205 defines a first elongate segment 207 (FIG. 3 only) extending along the periphery of side block edge 172 between the lower longitudinal block edge 150 and the chamfer 209 (FIG. 3 only) defined at the top right side corner of the block. Strip 205 additionally defines a second elongate segment 211 (FIG. 3 only) which wraps around the lower right side corner of the block and then along the peripheral lower block edge 150 and terminates at a point located generally below the aperture 120.

In a manner similar to that known in the art and described in, for example, U.S. Pat. No. 6,559,735, plates 122, 124, 126, 128, 130, 132, 134, 136 are adapted to capacitively or inductively couple the resonators/holes defining apertures/openings 106, 108, 110, 112, 114, 116, 118, 120 to the ground plates/strips 202, 204 and 205. Portions of selected ones of the plates 122, 124, 126, 128, 130, 132, 134, 136 also couple the associated resonators/holes to I/O pads 176 and 178 respectively. Alternative signal plates/strips 212 and 214 couple adjacent and non-adjacent proximate resonators/holes through selected ones of the plates 122, 124, 126, 128, 130, 132, 134, 136.

Capacitive or inductive coupling between the resonators defined by the through-holes 109 terminating in respective apertures 106, 108, 110, 112, 114, 116, 118, 120 is accomplished at least in part through the conductive material of block 104 and is varied by varying the size, shape, thickness, and peripheral configuration of selected ones of the plates 122, 124, 126, 128, 130, 132, 134, 136 and the distance between resonators/holes 109. The particular desired application, of course, determines the size and shape of the respective plates 122, 124, 126, 128, 130, 132, 134, 136.

Moreover, and although not described in any detail herein, it is understood that plate 122, in combination with the through-hole 109 associated therewith defining aperture 106, defines a high side shunt zero, that the space defined between plates 124 and 126, in combination with the respective through-holes 109 associated therewith defining respective apertures 108 and 110, defines a low side transmission zero, and that the space between plates 126 and 128, in combination with the respective through-holes 109 associated therewith defining respective apertures 110 and 112, defines another low side transmission zero. It is further understood that the finger 208 of ground strip 202 in combination with the space defined between plates 128 and 130 and the through-holes 106 associated therewith defining respective apertures 112 and 114 defines a high side transmission zero, while the finger 210 of ground strip 202 in combination with the space defined between plates 130 and 132 and the respective through-holes 109 associated therewith defining respective apertures 114 and 116, defines another high side transmission zero.

In accordance with the principles of the present invention, plate 134, in combination with the respective through-hole 109 associated therewith defining aperture 118, defines a primary shunt zero which directly capacitively or inductively couples the through-hole 109 defining the aperture 118 to the input/output pad 178.

Plate 136, in combination with the respective through-hole 109 associated therewith defining aperture 120, defines a secondary shunt zero which, in the embodiment shown, indirectly capacitively or inductively couples the through-hole 109 defining the aperture 120 to the input/output pad 178 via the indirect input/output coupling bar 192.

A comparison of the performance of the filter 100 of the present invention (as shown in FIGS. 1 and 3) to the performance of a standard filter 40 of the type shown in FIG. 2 will now be described with respect to FIG. 4 which depicts the performance graphs or plots 300 and 302 of respective filters 40 and 100 in superimposed relationship for comparison purposes.

Figure 4:
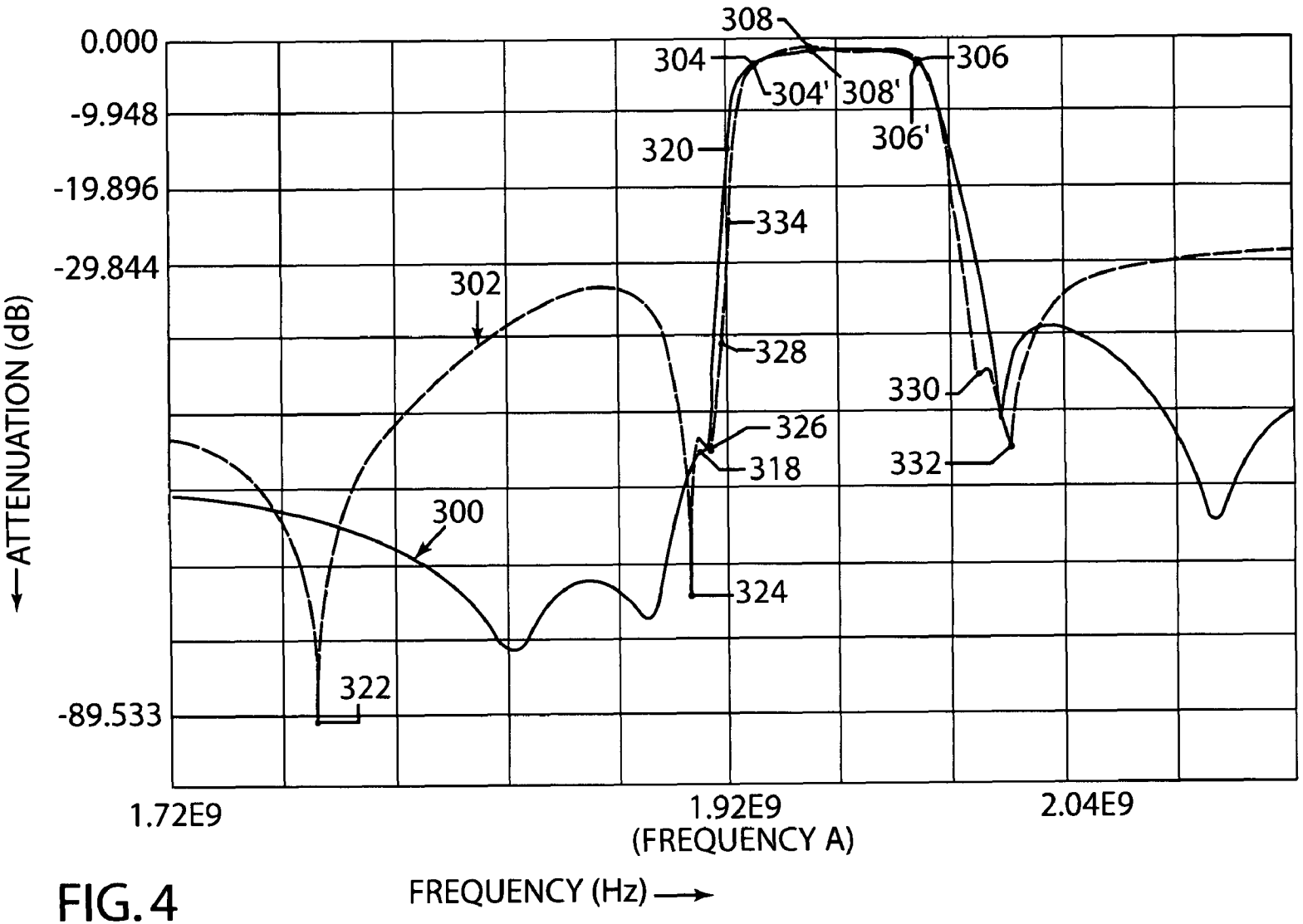
FIG. 4 is an attenuation/frequency response graph showing the performance of both the standard filter of FIG. 2 and the new filter of FIGS. 1 and 3 in superimposed relationship for comparison purposes.

By way of introduction, FIG. 4 initially includes points 304, 304' and 306 and 306' denoting respectively on each of the plots 300 and 302 the start and stop frequencies of the bandpass which, of course, is defined by the customer and the particular intended application. The region or portion of each of the plots 300 and 302 extending respectively between points 304 and 306 and 304' and 306' defines the bandpass. The points 308 and 308' on each of the plots 300 and 302 respectively in turn define the minimum insertion loss points in the bandpass, while the points 304 and 304' defined above respectively define the maximum insertion loss points for each of the plots 300 and 302.

Filter ripple, in turn, is defined on the plots 300 and 302 respectively by the difference in dB between the attenuation value at the respective maximum insertion loss points 304 and 304' and the loss value at the minimum insertion loss points 308 and 308' across the bandpass start and stop points 304 and 306 and 304' and 306' respectively.

In repeater applications, performance is directly proportional to the delta between minimum and maximum insertion loss points with a small delta corresponding to increased performance. The point 318 on the plot 300 of the standard filter 40 corresponds to the single electrical notch defined and created through the use of the single shunt zero 50 of the standard filter shown in FIG. 2. However, and as described above, in return for increased rejection on plot 300 at point 320, there is a corresponding gain at point 304 of insertion loss, i.e., a disadvantageous performance characteristic.

The point 322 on the plot 302 for filter 100 corresponds to the electrical notch defined by the use of indirect I/O coupling bar 192. Point 324 on the plot 302 of filter 100 corresponds to the electrical notch defined and created by the low frequency side transmission zeros defined in combination by the gap between plates 124 and 126, the gap defined between plates 126 and 128, the non-adjacent coupling bar 212, and the associated through-holes 109.

Point 326 on the plot 302 for filter 100 corresponds to the electrical notch defined and created by the primary (low frequency side) shunt zero plate 134 and associated through-hole 109 of filter 100, while point 328 on the plot 302 corresponds to the electrical notch defined and created by the secondary (low frequency side) shunt zero plate 136 and associated through-hole 109 of filter 100.

Point 330 on the plot 302 for filter 100 corresponds to the electrical notch defined and created by the high frequency side shunt zero plate 122 and associated through-hole 109.

Point 332 on the plot 302 for filter 100 corresponds to the electrical notch defined and created by the high frequency side transmission zeros defined by the fingers 208 and 210 in combination with the gaps between plates 128 and 130 and plates 130 and 132 respectively and associated through-holes 109.

Point 320 on the plot 300 represents the point at which the plot 300 crosses the vertical line on the graph corresponding to Frequency A (which in the particular application is 1.92 GHz), while point 334 on the plot 302 represents the point at which the plot 302 crosses the vertical line on the graph corresponding to the same Frequency A.

Of course, insertion loss increases as points 326 and 328 move closer in frequency to the frequency of the start of the bandpass (denoted by point 304'). Thus, and for applications such as repeater applications, the maximum rejection possible is desired between points 304' and 328.

It is noted that point 320 on the plot 300 for filter 40 is at the same frequency point (i.e., Frequency A) as the point 334 on the plot 302 for filter 100 except that the point 334 has a greater attenuation value. Thus, and with reference to such Frequency A, FIG. 4 shows that the use of a filter constructed in accordance with the present invention to include primary and secondary shunt zeros directly or indirectly capacitively or inductively coupled to an input/output pad defines a filter 100 with improved attenuation without a resultant increase in ripple.

Numerous variations and modifications of the embodiment described above may be effected without departing from the spirit and scope of the novel features of the invention. No limitations with respect to the specific module illustrated herein are intended or should be inferred.

For example, it is understood that the invention encompasses other embodiments where the head 187 of the input/output pad 178 is shaped or configured to extend into direct coupling relationship with the secondary shunt zero plate 136, thus eliminating the need for the separate indirect coupling bar 192.

As another example, it is understood that the invention encompasses still other embodiments including more than two shunt zeros such as, for example, the embodiment wherein the length of the filter is increased and additional poles and corresponding surrounding plates are formed between the apertures 118 and 120 and either directly or indirectly coupled to the existing input/output pad 178 to define a filter with multiple (i.e., more than two) shunt zeros depending, of course, upon the particular application.

As a further example, it is understood that the invention encompasses other embodiments where the shape, length, width, thickness and/or height of any of the plates or I/O pads has been modified depending upon the desired frequency, attenuation requirements, and/or physical attributes of the ceramic block.

As still a further example, it is understood that the single or multiple capactively or inductively, directly or indirectly coupled shunt zeros of the present invention provide the desired electrical performance where additional attenuation is needed near the bandpass edge(s), irrespective of whether such additional attenuation requirement is either lower or higher in frequency to the bandpass with minimal degradation to the bandpass's insertion loss impacting the bandpass ripple. Thus, the invention is not limited in operation by either bandpass frequencies or the bandwidths of the bandpass.

I claim:

1. A filter comprising:

a block defined by top, bottom and side surfaces wherein said side and bottom surfaces are substantially covered with a conductive material and said top surface defines opposed longitudinal peripheral edges and opposed first and second side peripheral edges;

a plurality of spaced-apart through-holes extending between the top and bottom surfaces of said block and defining a plurality of respective spaced-apart apertures in the top surface, said through-holes having respective interior surfaces covered by said conductive material;

a plurality of capacitive plates comprised of said conductive material and surrounding a plurality of said respective apertures for capacitively coupling said respective through-holes to each other and to said conductive material on the side surfaces of said block, at least first and second plates of said plurality of plates in combination with first and second through-holes of said plurality of through-holes associated therewith defining first and second shunt zeros respectively; and at least a first input/output pad defined by conductive material on said top surface of said block and coupled to said first and second through-holes with said first and second plates defining said first and second shunt zeros, said first and second through-holes with said first and second plates defining said first and second shunt zeros being located on said block between said first input/output pad and said first side peripheral edge and said second through-hole with said second plate defining said second shunt zero being located on said block between said first through-hole with said first plate defining said first shunt zero and said first side peripheral edge, said first and second through-holes of said plurality of through-holes with said first and second plates defining said first and second shunt zeros being arranged in the same direction as the other ones of said plurality of through-holes.

2. The filter of claim 1 wherein said first input/output pad is coupled to both of said first and second through-holes associated with said first and second plates defining said first and second shunt zeros.

3. A filter comprising:

a block defined by top, bottom and side surfaces wherein said side and bottom surfaces are substantially covered with a conductive material and said top surface defines opposed longitudinal peripheral edges and opposed first and second side peripheral edges;

a plurality of spaced-apart through-holes extending between the top and bottom surfaces of said block and defining a plurality of respective spaced-apart apertures in the top surface, said through-holes having respective interior surfaces covered by said conductive material;

a plurality of capacitive plates comprised of said conductive material and surrounding a plurality of said respective apertures for capacitively coupling said respective through-holes to each other and to said conductive material on the side surfaces of said block, at least first and second plates of said plurality of plates in combination with first and second through-holes of said plurality of through-holes associated therewith defining first and second shunt zeros respectively; and at least a first input/output pad defined by conductive material on said top surface of said block and coupled to said first and second through-holes with said first and second plates defining said first and second shunt zeros, said first and second through-holes with said first and second plates defining said first and second shunt zeros being located on said block between said first input/output pad and said first side peripheral edge and said second through-hole with said second plate defining said second shunt zero being located on said block between said first through-hole with said first plate defining said first shunt zero and said first side peripheral edge, said plurality of spaced-apart through-holes all being located in a co-linear relationship.

4. A filter comprising:

a block defined by top, bottom and side surfaces wherein said side and bottom surfaces are substantially covered with a conductive material and said top surface defines opposed longitudinal peripheral edges and opposed first and second peripheral side edges;

a plurality of spaced-apart through-holes extending between the top and bottom surfaces of said block and defining a plurality of spaced-apart apertures in the top surface, said through-holes including corresponding interior surfaces covered by said conductive material;

a plurality of plates comprised of said conductive material and surrounding a plurality of said respective apertures for coupling said respective through-holes to each other and said conductive material on the side surfaces of said block;

at least a first plate of said plurality of plates in combination with a first through-hole of said plurality of through-holes defining at least a first shunt zero and at least a second plate of said plurality of plates in combination with a second through-hole of said plurality of through-holes defining at least a second shunt zero, said first and second through-holes of said plurality of through-holes being arranged in the same direction as the other ones of said plurality of through-holes;

at least a first input/output pad defined by conductive material on said top surface of said block and coupled to said first through-hole of said first shunt zero, said first and second through-holes defining said first and second shunt zeros being located on said block between said first input/output pad and said first side peripheral edge and said second through-hole defining said second shunt zero being located on said block between said first through-hole defining said first shunt zero and said first peripheral side edge; and a coupling bar extending between said first input/output pad and said second plate of said second shunt zero for coupling said second through-hole of said second shunt zero to said first input/output pad.

* * * * *

UNITED STATES PATENT AND TRADEMARK OFFICE

CERTIFICATE OF CORRECTION

PATENT NO. : 7,952,452 B2
APPLICATION NO. : 12/454541
DATED : May 31, 2011
INVENTOR(S) : Justin Russell Morga It is certified that error appears in the above-identified patent and that said Letters Patent is hereby corrected as shown below:

Column 5, line 53, "slot 198." should be changed to --slot 198 as shown in FIG. 3 only.--; line 56 "prong" should be changed to --finger--; line 59 "prongs of bar 192" should be changed to --fingers 194 and 196 of coupling bar 192--

Signed and Sealed this
Twentieth Day of March, 2012

David J. Kappos

David J. Kappos
*Director of the United States Patent and Trademark Office*